US009950525B2

(12) United States Patent
Oohashi et al.

(10) Patent No.: US 9,950,525 B2
(45) Date of Patent: Apr. 24, 2018

(54) ELEMENT SUBSTRATE FOR LIQUID EJECTING HEAD AND WAFER

(71) Applicant: CANON KABUSHIKI KAISHA, Tokyo (JP)

(72) Inventors: Ryoji Oohashi, Yokohama (JP); Koichi Omata, Kawasaki (JP); Hideo Tamura, Kawasaki (JP); Takaaki Yamaguchi, Yokohama (JP); Kousuke Kubo, Kawasaki (JP); Suguru Taniguchi, Kawasaki (JP); Yuji Tamaru, Yokohama (JP); Toshio Negishi, Yokohama (JP); Yohei Osuki, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 13 days.

(21) Appl. No.: 15/287,379

(22) Filed: Oct. 6, 2016

(65) Prior Publication Data

US 2017/0100930 A1 Apr. 13, 2017

(30) Foreign Application Priority Data

Oct. 9, 2015 (JP) ..... 2015-200916

(51) Int. Cl.
*B41J 2/14* (2006.01)

(52) U.S. Cl.
CPC ..... *B41J 2/1433* (2013.01); *B41J 2/14201* (2013.01); *B41J 2/14088* (2013.01); *B41J 2002/14217* (2013.01)

(58) Field of Classification Search
CPC ..... B41J 2/1433; B41J 2/14201; B41J 2002/14217; B41J 2/14088
See application file for complete search history.

(56) References Cited

U.S. PATENT DOCUMENTS 7,267,430 B2 9/2007 Parish
2011/0310183 A1* 12/2011 Tamaru ..... B41J 2/14072 347/65
2014/0307028 A1* 10/2014 Omura ..... B41J 2/1433 347/44

FOREIGN PATENT DOCUMENTS

JP 2002079672 A 3/2002
JP 2004050636 A 2/2004

* cited by examiner

*Primary Examiner* — Manish S Shah
*Assistant Examiner* — Yaovi M Ameh
(74) *Attorney, Agent, or Firm* — Canon USA, Inc., IP Division

(57) ABSTRACT

An element substrate for a liquid ejecting head includes a substrate, an element forming layer on the substrate, and a discharge port forming member formed of an insulating member on the element forming layer. The element forming layer includes an energy generating element configured to provide energy to a liquid for ejection. The discharge port forming member includes a discharge port forming surface having discharge ports through which the liquid is ejected and an exterior side surface positioned between the discharge port forming surface and the element forming layer. The exterior side surface has a first edge facing the element forming layer. The element substrate further includes a conductive layer disposed between the first edge and the element forming layer and grounded.

17 Claims, 10 Drawing Sheets

ELEMENT SUBSTRATE FOR LIQUID EJECTING HEAD AND WAFER

BACKGROUND OF THE INVENTION

Field of the Invention

The aspects of the present invention relate to an element substrate for a liquid ejecting head and a wafer including a plurality of element substrates, and particularly to a configuration that prevents electro-static discharge (ESD) damage (hereinafter, may be referred to as ESD damage) to the element substrate.

Description of the Related Art

A liquid ejecting apparatus such as an inkjet printer is known as an example of information output apparatuses configured to record information such as a character and an image on a recording medium such as a sheet and film. The liquid ejecting apparatus includes a liquid ejecting head that applies liquid droplets onto a recoding medium for recording. A thermal inkjet process is known as an example of liquid ejecting processes performed by the liquid ejecting head. In the thermal inkjet process, a current is passed through the heating resistor, which is in contact with the ink, for about a few μ seconds to generate a thermal energy. The bubbling of the ink caused by the thermal energy is used to eject the ink droplets. The liquid ejecting head for the thermal inkjet process generally includes an element substrate including a heating resistor used for ejection of the ink droplets. The element substrate includes a silicon substrate, an element forming member including the heating resistor, on the silicon substrate, and a discharge port forming member including a discharge port, on the element forming member.

In a production step of the element substrate or in a recording operation by the liquid ejecting head, the element substrate may have ESD damage. Japanese Patent Laid-Open No. 2004-050636 describes that a dummy MOS (Metal-Oxide-Semiconductor) is connected in parallel with the heating resistor so as to prevent the ESD damage to the heating resistor (heater). A current flowing from the pad flows to the dummy MOS, preventing a large current from flowing into the heating resistor.

U.S. Pat. No. 7,267,430 describes that an anticavitation layer is connected to a grounded-gate MOS. The ESD current flowed into the anticavitation layer flows to the substrate through the grounded-gate MOS. Thus, the protective film between the anticavitation layer and the electrode for the heating resistor is unlikely to have the ESD damage.

SUMMARY OF THE INVENTION

The aspects of the present invention provide an element substrate for a liquid ejecting head including: a substrate; an element forming layer on the substrate, the element forming layer including an energy generating element configured to provide energy to a liquid for ejection; a discharge port forming member formed of an insulating member on the element forming layer, the discharge port forming member including a discharge port forming surface having discharge ports through which the liquid is ejected and an exterior side surface positioned between the discharge port forming surface and the element forming layer, the exterior side surface having a first edge facing the element forming layer; and a conductive layer disposed between the first edge and the element forming layer and arounded.

Further features of the aspects of the present invention will become apparent from the following description of exemplary embodiments with reference to the attached drawings.

DESCRIPTION OF THE EMBODIMENTS

An ESD occurs at various positions in an element substrate. An ESD current, which is caused by the ESD, on a surface of a discharge port forming member travels along the surface of the discharge port forming member. This is called surface discharge. In the configuration disclosed in Japanese Patent Laid-Open No. 2004-050636, the ESD current generated at a position closer than the pad to the discharge port, for example, may flow into the element substrate through the discharge port due to the surface discharge, resulting in the ESD damage to the protective film. The pad is generally disposed at an end portion of the element substrate, and thus most of the ESD current may flow into the element substrate, not into the pad.

In the configuration disclosed in U.S. Pat. No. 7,267,430, if a distance between the grounded-gate MOS and the heating resistor is large, the ESD damage may occur at a low-insulating portion of the protective film between the grounded-gate MOS and the heating resistor. In particular, the ESD damage readily occurs in a long liquid ejecting head, which tends to have a large distance between the grounded-gate MOS and the heating resistor.

The ESD damage readily occurs in the configurations disclosed in Japanese Patent Laid-Open. No. 2004-050636 and U.S. Pat. No. 7,267,430 when the ESD occurs at a position away from the pad or the grounded-gate MOS, which is a grounding component. The likelihood of occurrence of the ESD damage also depends on the internal configuration of the liquid ejecting head.

The aspects of the present invention provide an element substrate for a liquid ejecting head in which ESD damage is unlikely to occur regardless of the internal configuration of the liquid ejecting head and the occurrence position of the ESD.

Embodiments

Embodiments of the aspects of the present invention are described with reference to the drawings.

Figure 1:
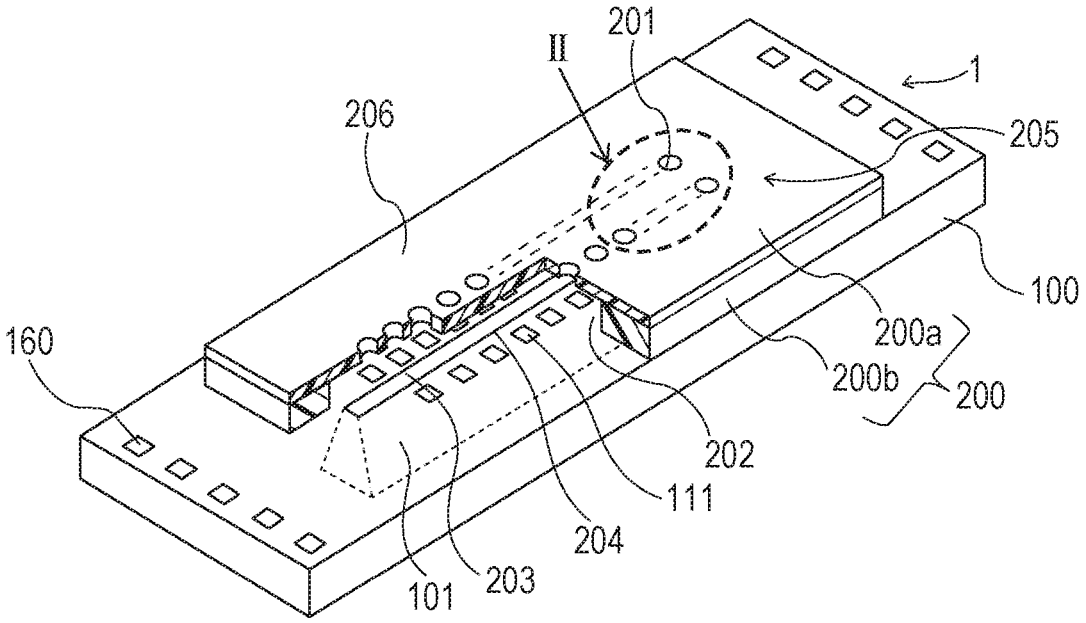
FIG. 1 is a schematic perspective view of an element substrate for a liquid ejecting head of the aspects of the present invention.
Figure 2A:
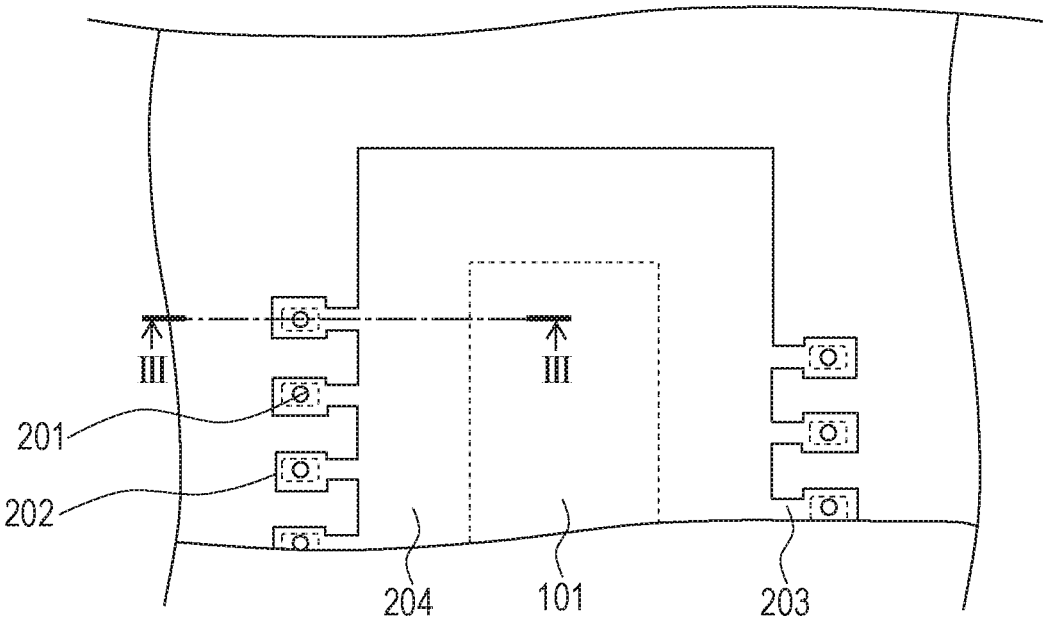
FIGS. 2A and 2B are schematic plan views of a portion II of the element substrate in FIG. 1.
Figure 2B:
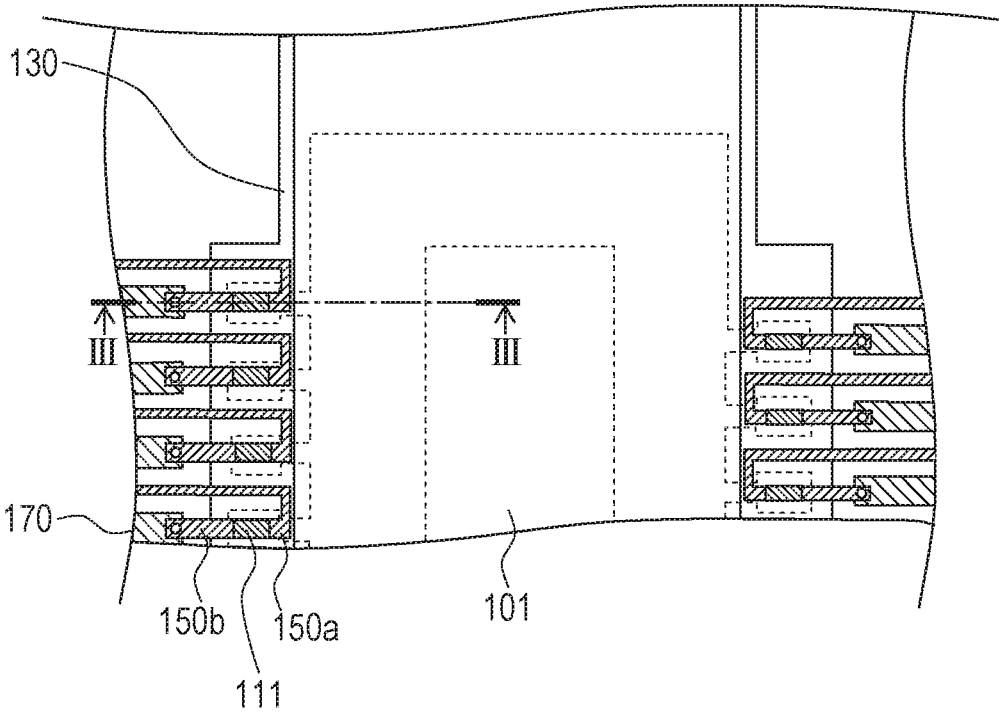
Figure 3:
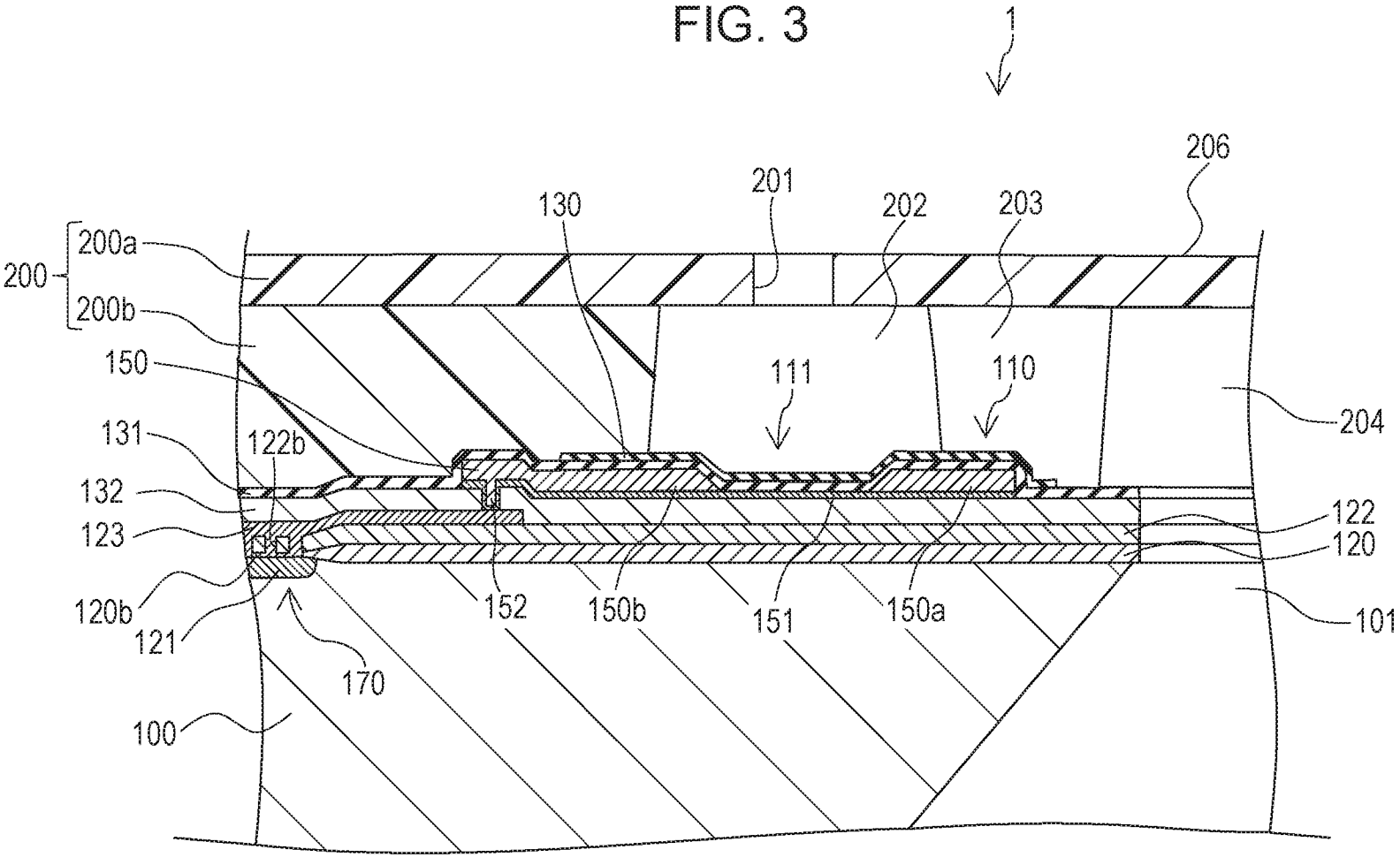
FIG. 3 is a schematic cross-sectional view of the element substrate taken along line III-III in FIGS. 2A and 2B.

FIG. 1 is a perspective view illustrating an element substrate for a liquid ejecting head according to a first embodiment of the aspects of the invention. FIG. 2A is a magnified plan view of a portion II in FIG. 1. FIG. 2B is a transparent view in which a discharge port forming member in FIG. 2A is indicated by a broken line. FIG. 3 is a cross-sectional view taken along line III-III in FIGS. 2A and 2B.

An element substrate 1 for the liquid ejecting head includes a substrate 100, an element forming layer 110 on the substrate 100, and a discharge port forming member 200 on the element forming layer 110. The substrate 100 is formed of silicon and includes an ink supply channel 101 through which the ink is supplied. Energy generating elements 111, which are configured to provide energy to the liquid for ejection, are disposed on the element forming layer 110. In this embodiment, the energy generating element is a heating resistor (heater) 111. The discharge port forming member 200 is formed of an insulating member such as an epoxy resin material and includes a ceiling member 200*a* and a side surface member 200*b*. The side surface member 200*b* defines bubbling chambers 202 provided for corresponding heating resistors 111, a liquid chamber 204 common to the bubbling chambers 202, and a communication channel 203 positioned between the liquid chamber 204 and the bubbling chambers 202 and through which the ink is introduced to the bubbling chambers 202. The ceiling member 200*a* includes a plurality of discharge ports 201 through which the ink is elected. The discharge ports 201 are provided for corresponding heating resistors 111. The discharge ports 201 are arranged lineally to form a discharge port array 205. In this embodiment, one discharge array 205 is disposed on each side of the ink supply channel 101, but may be disposed on one side of the ink supply channel 101. A surface of the ceiling member 200*a* away from the side surface member 200*b* is a discharge port forming surface 206 including the discharge ports 201. Terminals 160 are disposed on the substrate 100 so as to supply a voltage or a signal from an external device to the heating resistors 111 of the liquid ejection head. The ink is supplied from an ink tank, which is not illustrated, to the bubbling chamber 202 through the ink supply channel 101, the liquid chamber 204, and the communication channel 203. The ink is heated by the heating resistor 111 adjacent to the bubbling chamber 202 and a bubble is formed, and then the ink in the form of liquid droplet is ejected through the discharge port 201.

As illustrated in FIG. 2B, each heating resistor 111 is electrically connected to a common heating resistor electrode 150*a* and an individual heating resistor electrode 50*b*. The individual heating resistor electrode 150*b* is connected to a switching element 170 at an end away from the heating resistor 111. An anticavitation layer 130 is disposed on the heating resistor 111. The anticavitation layer 130 is a protection layer that protects the heating resistors 111 from thermal, physical, and chemical impact caused during the bubbling or debubbling of the ink.

As illustrated in FIG. 3, a thermally oxidized film 120 and a gate oxidized film 121 are disposed on the substrate 100. A first heat storage layer 122 is disposed on the thermally oxidized film 120. A first switching element electrode 123 is disposed on the first heat storage layer 122. The first switching element electrode 123 is connected to the substrate 100 through a via hole 122*b* in the first heat storage layer 122. The first switching element electrode 123 includes an impurity diffusion region 120*b* at the connection region. The first switching element electrode 123, the impurity diffusion region 120*b*, the substrate 100, a second switching element (not illustrated), and a gate electrode (not illustrated) constitute a switching element 170. A second heat storage layer 132 is disposed on the first switching element electrode 123. A heater layer 151 is disposed on the second heat storage layer 132. The common heating resistor electrode 150*a* and the individual heating resistor electrode 150*b* are disposed on the heater layer 151. Each of the common heating resistor electrode 150*a* and the individual heating resistor electrode 150*b*, which is connected to the heater layer 151, has a thickness of 1000 nm. A portion of the heater layer 151 positioned between the common heating resistor electrode 150*a* and the individual heating resistor electrode 150*b* is the heating resistor 111 configured to generate heat that causes the ink to form a bubble. The heater layer 151 is connected to the first switching electrode 123 through a via hole 152 in the second heat storage layer 132. An insulating protective film 131 formed of SiCN and having a thickness of 300 nm covers the common heating resistor electrode 150*a*, the individual heating resistor electrode 150*b*, and the heater layer 151. The protective film 131 extends to an outside of the discharge port forming member 200 (see FIG. 8). SiCN is a material having reliable chemical stability and high electrical insulating properties. The protective film 131 may be formed of SiN, which has high electrical insulating properties, or SiC, which has reliable chemical stability to the ink. The anticavitation layer 130 formed of Ta and having a thickness of 200 nm covers a portion of the protective film 131. The films between the thermally oxidized film 120 and the anticavitation layer 130 constitute the element forming layer 110. The side surface member 200*b* of the discharge port forming member 200 is disposed on the element forming layer 110, specifically on the anticavitation layer 130 and the protective film 131.

Figure 4:
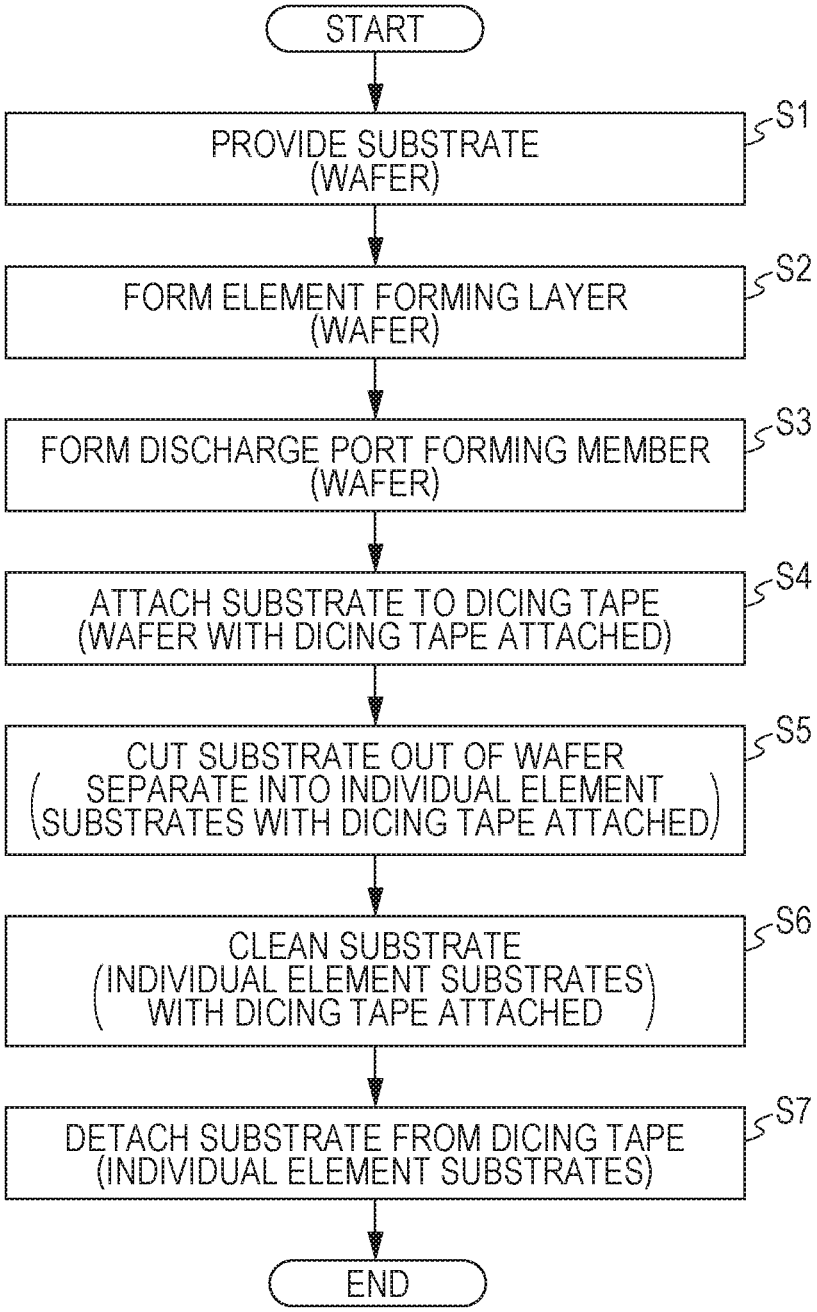
FIG. 4 is a schematic flow chart indicating production steps of the element substrate.
Figure 5:
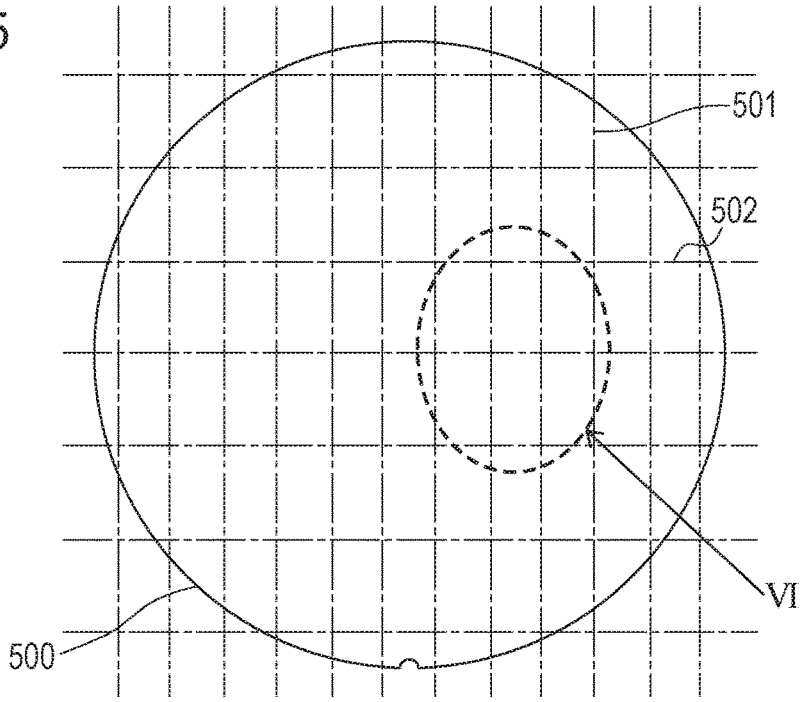
FIG. 5 is a schematic plan view of a wafer.

FIG. 4 is a schematic flow chart indicating an example of production steps of the element substrate 1. First, the substrate 100 in the form of a wafer is provided (Step S1). Then, a film formation step using a thermal oxidation process, a CVD process, or a sputtering process, for example, a patterning step using photolithography, for example, and an impurity doping process using a thermal diffusion process or an ion implantation process, for example, are performed to form the element forming layer 110 on the substrate 100 (Step S2). The element forming layer 110 includes the heating resistors 111. Then, a dry film is attached to the substrate 100 in the form of a wafer and resist coating, for example, is performed to form the discharge port forming member 200 (Step S3). Then, the substrate 100 in the form of a wafer is attached to a dicing tape (Step S4). Then, the substrate 100 is cut out of the wafer with a diamond sew, for example (Step S5). FIG. 5 shows a wafer 500 before cut and cut lines (scribe regions) 501 and 502. Then, the element substrates 1 cut out of the wafer are cleaned to remove swarf, for example, while being attached to the dicing tape (Step S6). Two-fluid cleaning, which cleans with a cleaner including water and nitrogen, can be performed for cleaning. After the cleaning, the dicing tape is detached from the substrate 100, and thus individual element substrates 1 are produced (Step 37). Then, the element substrates 1 are each mounted in the liquid ejecting head.

Hereinafter, embodiments of the aspects of the present invention, are described in detail. The above-described configuration is common to all embodiments.

First Embodiment

Figure 6:
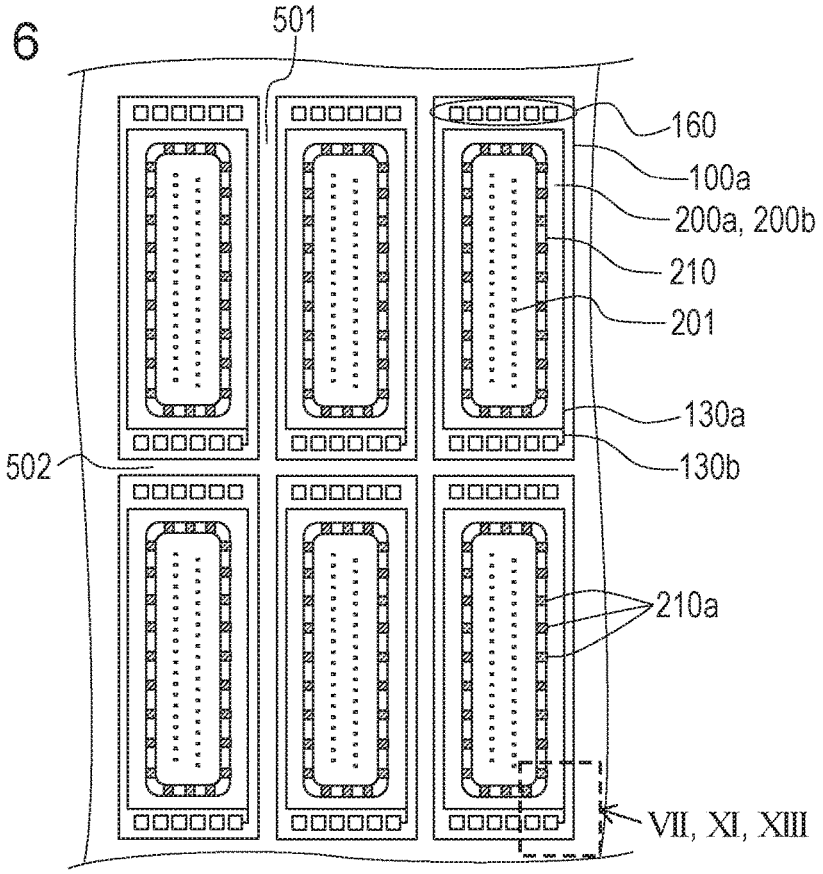
FIG. 6 is a plan view of a portion of a wafer according to a first embodiment.
Figure 7:
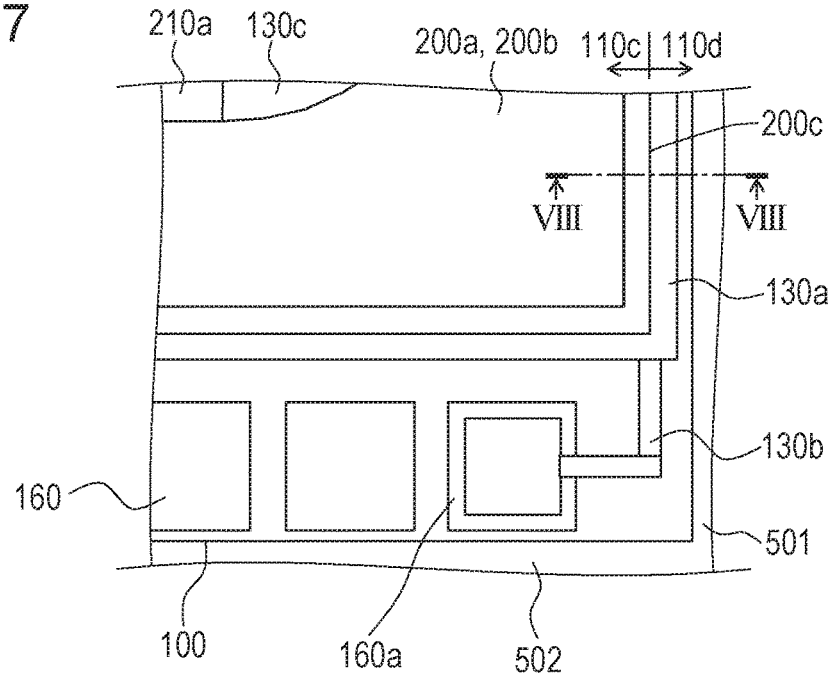
FIG. 7 is a magnified view of a portion VII in FIG. 6.
Figure 8:
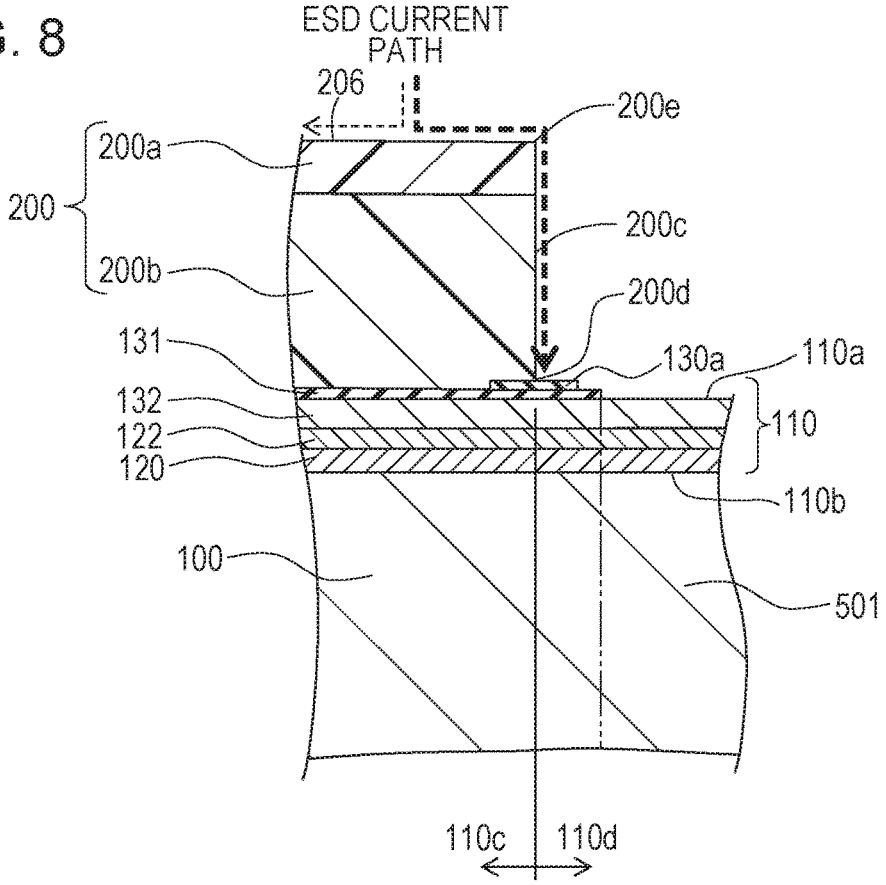
FIG. 8 is a conceptual diagram of an ESD current path in the first embodiment.

FIG. 6 is a plan view of the element substrates 1 formed on a silicon wafer and is a magnified view of a portion VI in FIG. 5. FIG. 7 is a magnified view of a portion VII in FIG. 6. FIG. 8 is a cross-sectional view taken along line VIII-VIII in FIG. 7. A wafer having a diameter of 200 mm includes 270 element substrate regions 100*a* separated by the scribe regions. The element substrate 1 including a plurality of heating resistors 111 are disposed in each element substrate region 100*a*.

The discharge port forming surface 206 of the discharge port forming member 200 includes a groove 210 surrounding the discharge ports 201 (two discharge port arrays 205 in this embodiment) to reduce the stress applied to the discharge port forming member 200, which is connected to the substrate 100. The groove 210 is formed by removing a portion of the discharge port forming member 200. The groove 210 extends through the ceiling member 200*a* and the side surface member 200*b* such that the element forming layer 110 is exposed. Bridge portions 210*a* across the groove 210 in the width direction are disposed to protect the element forming layer 110. The bridge portions 210*a* are formed of the same material as the discharge port forming member 200. In this embodiment, the bridge portions 210*a* having a width of 100 μm is arranged at an interval of 200 μm. In addition, a protective film. 130*c*, which is formed of the same material as the anticaviation layer 130, covers the surface of the element forming layer 110 exposed by the groove 210 to protect the element forming layer 110.

The element forming layer 110 includes a second surface 110*b* facing the substrate 100 and a first surface 110*a* opposite the second surface 110*b*. The discharge port forming member 200 is disposed on the first surface 110*a*. The first surface 110*a* includes an interior portion 110*c* and an exterior portion 110*d* located outwardly from the interior portion 110*c*. The interior portion 110*c* is a surface of the element forming layer 110 under the discharge port forming member 200. The exterior portion 110*d* is a portion of the surface of the element forming layer 110 on which the discharge port forming member 200 is not disposed. The discharge port forming member 200 includes an exterior side surface 200*c* positioned between the discharge port forming surface 206 and the element forming layer 110. In other words, a border between the interior portion 110*c* and the exterior portion 110*d* corresponds to the exterior side surface 200*c* of the discharge port forming member 200 when viewed in a direction perpendicular to the substrate 100. The exterior side surface 200*c* has a first edge 200*d* adjacent to the element forming layer 110 and a second edge 200*e* adjacent to the discharge port forming surface 206 (i.e., the second edge 200*e* forms a border between the exterior side surface 200*c* and the discharge port forming surface 206).

A conductive layer 130*a* formed of Ta and having a thickness of 200 nm and a width of 20 μm is disposed between the first edge 200*d* of the exterior side surface 200*c* of the discharge port forming member 200 and the element forming layer 110. The conductive layer 130*a* may be formed of any other material having conductivity and ink resistivity than Ta. The conductive layer 130*a* is conductive wiring configured to attract an ESD current. The conductive layer 130*a* has a portion in contact with the protective film 131 at a position outside the discharge port forming member 200. Since the conductive layer 130*a* is formed of the same material as the anticavitation layer 130, those layers are formed in one process at the same time. The conductive layer 130*a* is electrically connected to a conductive pad, which is electrically grounded to the substrate 100 through an electrical connection layer 130*b* disposed on the exterior portion 110*d* of the first surface 110*a* of the element forming layer 110. The electrical connection layer 130*b* may be formed of the same material as the conductive layer 130*a* and the anticavitation layer 130. The pad is one of a plurality of external connection pads 160, and is a arounded-GND pad 160*a* electrically connected to the substrate 100. Thus, the conductive layer 130*a* is electrically connected to the substrate 100. The conductive layer 130*a* is not electrically connected to the anticavitation layer 130 on the heating resistors 111 and the protective film 130*c* in the groove 210. In other words, the conductive layer 130*a* is electrically separated from the anticavitation layer 130 on the heating resistors 111 and the protective film 130*c*. Other components than the pad may be used to connect the conductive layer 130*a* to the substrate 100. In addition, the conductive layer 130*a* may be electrically connected to a member outside the substrate 100 through an external connection pad, for example, and grounded instead of electrically connected to the substrate 100. This enables the ESD current to be introduced to the exterior side surface 200*c* of the discharge port forming member 200 and to be readily released to the outside of the discharge port forming member 200.

The exterior side surface 200*c* of the discharge port forming member 200 may be in contact with or away from the conductive layer 130*a*. When the exterior side surface 200*c* is away from the conductive layer 130*a*, a layer between the first edge 200*d* of the exterior side surface 200*c* of the discharge port forming member 200 and the conductive layer 130*a* can be an insulating layer such as an adhesive layer. This configuration reliably causes the surface discharge between the exterior side surface 200*c* of the discharge port forming member 200 and the conductive layer 130*a*. The conductive layer 130*a* extends over a border between the interior portion 110*c* and the exterior portion 110*d* of the element forming layer 110 with the exterior side surface 200*c* of the discharge port forming member 200 therebetween. In other words, the inner peripheral portion of the conductive layer 130*a* is positioned between the element forming layer 110 and the discharge port forming member 200, and the outer peripheral portion of the conductive layer 130*a*, which extends along the entire circumference of the discharge port forming member 200, is exposed at a position outside the discharge port forming member 200. The inner peripheral portion of the conductive layer 130*a* may be eliminated. The conductive layer 130*a* extends continuously along the entire circumference of the discharge port forming member 200, but may extend partially or discontinuously along the entire circumference of the discharge port forming member 200.

A wafer of a comparative example 1 is provided which has the configuration identical to that of the wafer in the first embodiment except that the comparative example 1 does not include the conductive layer 130*a*. After the wafer of the comparative example 1 was subjected to the cleaning step, it was found that the ESD damage occurred at 30 places in the entire wafer. The ESD damage was found at positions close to the electrodes 150*a* and 150*b* for the heating resistor 111 and to the groove 210. The ESD damage at the position close to the groove 210 was found at the wiring layer connected to the electrodes 150*a* and 150*b*. The ESD damage was particularly concentrated on the edge of the wiring. The ESD damage to the side surface of the wiring may be readily caused due to the fact that the insulating properties of the protective film 131*c* is deteriorated by increasing the thickness of the wiring layer to reduce the resistance of the wiring layer.

Figure 9:
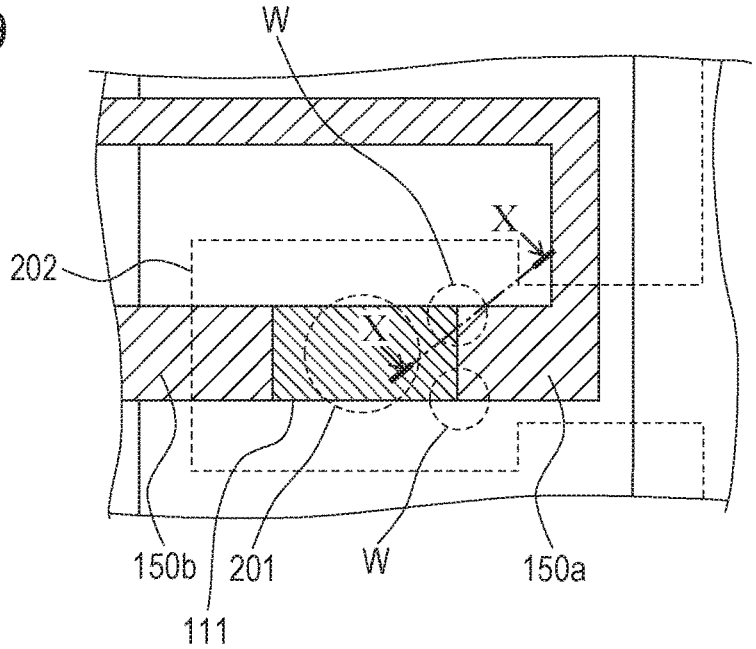
FIG. 9 is a magnified view of the heating resistor and peripheral portions thereof.
Figure 10:
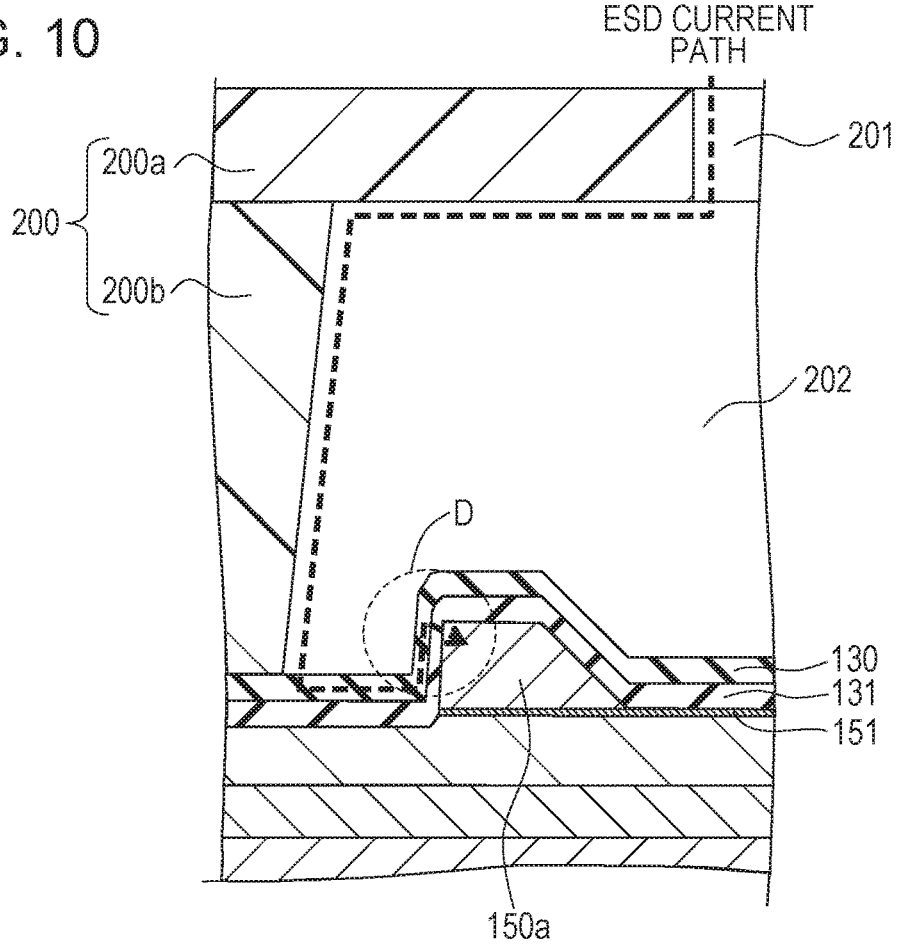
FIG. 10 is a cross-sectional view taken along line X-X in FIG. 9.

The following describes the possible mechanism of the ESD damage at the electrodes 150*a* and 150*b* for the heating resistor 111. FIG. 9 is a magnified plan view of the heating resistor 111 of the comparative example 1 and peripheral portions thereof. FIG. 10 is a cross-sectional view taken along line X-X in FIG. 9. Many ESD damage occurrences were found at the protective film 131 between the anticavitation layer 130 and the common heating resistor electrode 150*a* in a portion W (a border portion between the heating resistor 111 and the common heating resistor electrode 150*a*) in FIG. 9. This is caused by the surface discharge on the surface of the discharge port forming member 200. The surface discharge is electrical discharge along a surface of an insulating member in a system including the insulting member between a discharge source and a discharge destination. The surface of the discharge port forming member 200 is formed of an epoxy resin material, which is an insulating material. Thus, as illustrated in FIG. 10, the ESD current flows along the discharge port 201, the rear surface of the ceiling member 200*a*, and the inner wall of the side surface member 200*b* into the anticavitation layer 130, which is a conductor. Then, the ESD damage occurs (see, a portion D) in the protective film 131 between the anticavitation layer 130 and the common heating resistor electrode 150*a* at a portion having poor insulating properties or having a defect. Many ESD damage occurrences were found at a position adjacent to the common heating resistor electrode 150*a*, because the common heating resistor electrode 150*a*, which is connected to common heating resistor wiring (not illustrated), has a larger electrical capacity than the individual heating resistor electrode 150*b*.

Compared to the comparative example 1, in the first embodiment, the ESD damage occurrences after the cleaning step was found at five places, which is less than in the comparative example 1. As illustrated in FIG. 8, this reduction is achieved due to the fact that the ESD current is introduced to the exterior side surface 200*c* of the discharge port forming member 200 by the surface discharge so as to flow into the portion of the conductive layer 130*a* exposed at the position outside the discharge port forming member 200. The conductive layer 130*a* is grounded to the substrate 100 through the pad 160*a*, and thus the conductive layer 130*a* has a sufficient capacity unlike the anticavitation layer 130 covering the heating resistor 111 and the protective film 130*c* on the bottom of the groove 210.

The occurrence rate of the ESD damage is lower at some of the heating resistors 111 that are positioned adjacent to the pad 160*a*. The reduction may be achieved due to the fact that the ESD current partly flowed through the bridge portions 210*a* and flowed along the discharge port forming surface 206 to an exterior side of the groove 210.

As can be understood from the above, the ESD current generated at a portion exterior from the groove 210 is likely to be introduced toward the conductive layer 130*a*, not toward the groove 210 and the discharge ports 201. This may reduce the ESD damage not only at the position around the groove 210, but also at the position around the heating resistors 111. In this embodiment, since the conductive layer 130*a* is disposed on the exterior portion 110*d* of the element forming layer 110, the ESD current is effectively introduced to the exterior side surface 200*c* of the discharge port forming member 200. With this configuration, the ESD damage is less likely to occur even if the insulating properties of the protective film 131 are deteriorated by increasing the thickness of the electrodes 150*a* and 150*b* or the wiring layer connected to the electrodes 150*a* and 150*b*. In addition, since the ESD current is introduced to the outside of the discharge port forming member 200 in the aspects of the present invention, the layout of wiring in the element substrate region 100*a* and the configuration of the discharge port forming member 200 do not need to be changed to reduce the occurrence of the ESD damage.

Second Embodiment

Figure 11:
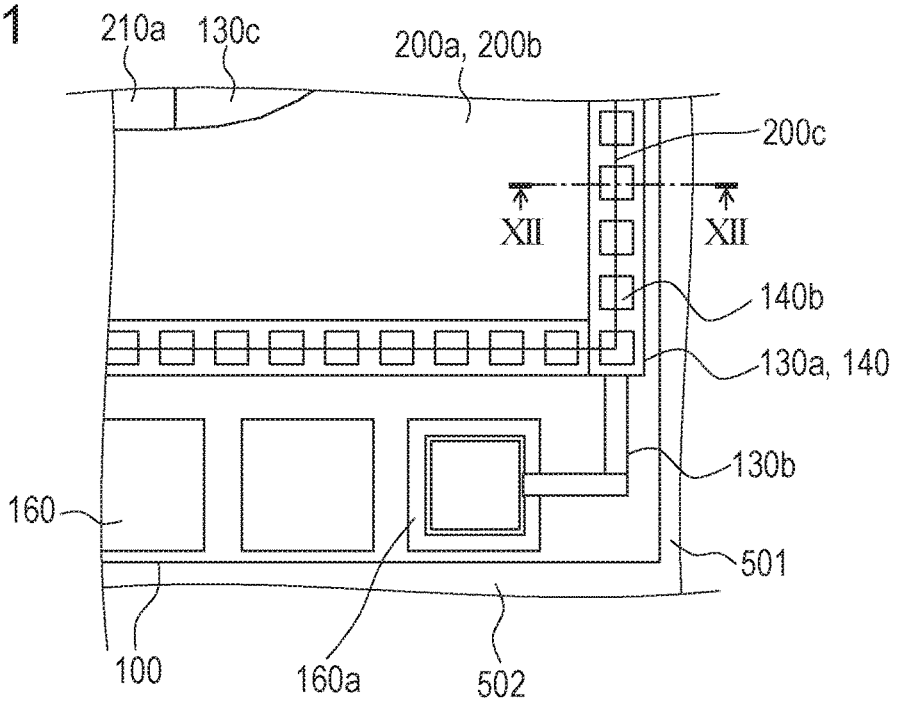
FIG. 11 is a magnified view of a portion XI according to a second embodiment.
Figure 12:
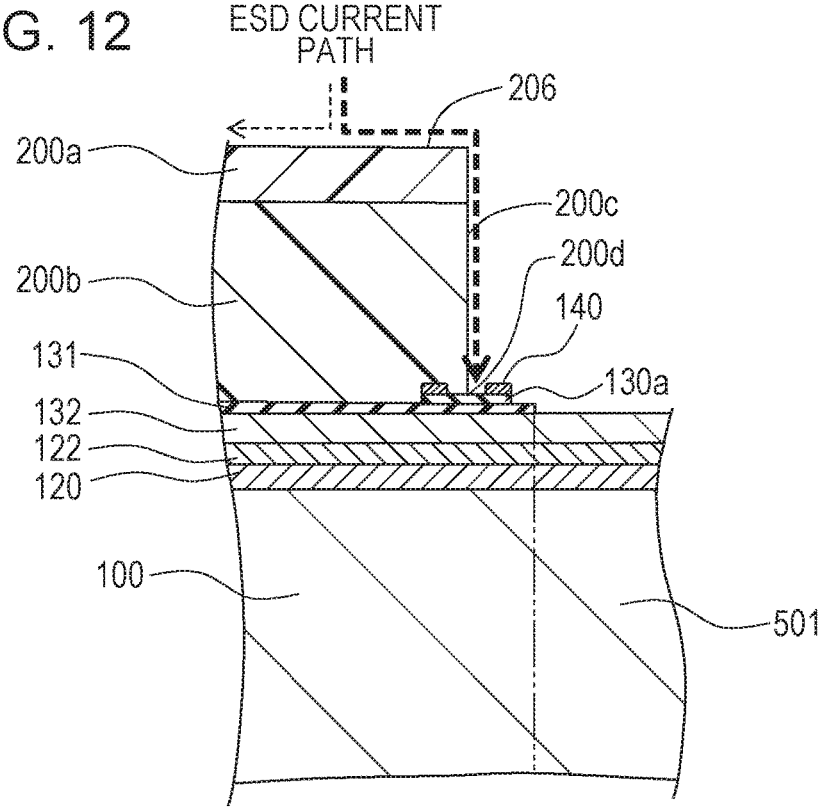
FIG. 12 is a cross-sectional view taken along line XII-XII in FIG. 11.

FIG. 11 is a magnified view of a portion XI in FIG. 6 and illustrates a second embodiment. FIG. 12 is a cross-sectional view taken along line XII-XII in FIG. 11. In the second embodiment, an adhesion improving layer (intermediate layer) 140 formed of SiO and having a thickness of 100 nm is disposed on the conductive layer 130*a* formed of Ta in order to improve adhesion between the element forming layer 110 and the discharge port forming member 200. The adhesion of the adhesion improving layer 140 to the discharge port forming member 200 is higher than the adhesion of the conductive layer 130 to the discharge port forming member 200. The adhesion improving layer 140 extends over the first edge 200*d* of the exterior side surface 200*c* of the discharge port forming member 200. The adhesion improving layer 140 has openings 140*b* extending over the first edge 200*d* of the exterior side surface 200*c* of the discharge port forming member 200. In other words, the opening portions 140*b* allow the conductive layer 130*a* to be partially exposed at the positions outside the discharge port forming member 200. In this embodiment, the openings 140*b* each in a square shape having four sides of 10 μm are arranged at an interval of 20 μm. The other configurations of the second embodiment are identical to those of the first embodiment. The adhesion improving layer 140 may be disposed only between the discharge port forming member 200 and the element forming layer 110 such that the conductive lever 130*a* positioned outside the discharge port forming member 200 is entirely exposed. The opening 140*b* may be a slit.

The ESD damage to the wafer of the second embodiment after the cleaning step was checked, and it was found that the ESD damage occurred at 10 places in the entire wafer. The reduction in the occurrence of the ESD damage may be achieved due to the fact that the openings 140*b* in the adhesion improving layer 140 through which the conductive layer 130*a* is exposed allowed the ESD current to be introduced to the conductive layer 130*a* by the surface discharge along the exterior side surface 200*c* of the discharge port forming member 200, as illustrated in FIG. 12. In this embodiment, the adhesion between the element forming layer 110 and the discharge port forming member 200 is maintained, and the occurrence of the ESD damage is reduced as in the first embodiment.

Third Embodiment

Figure 13:
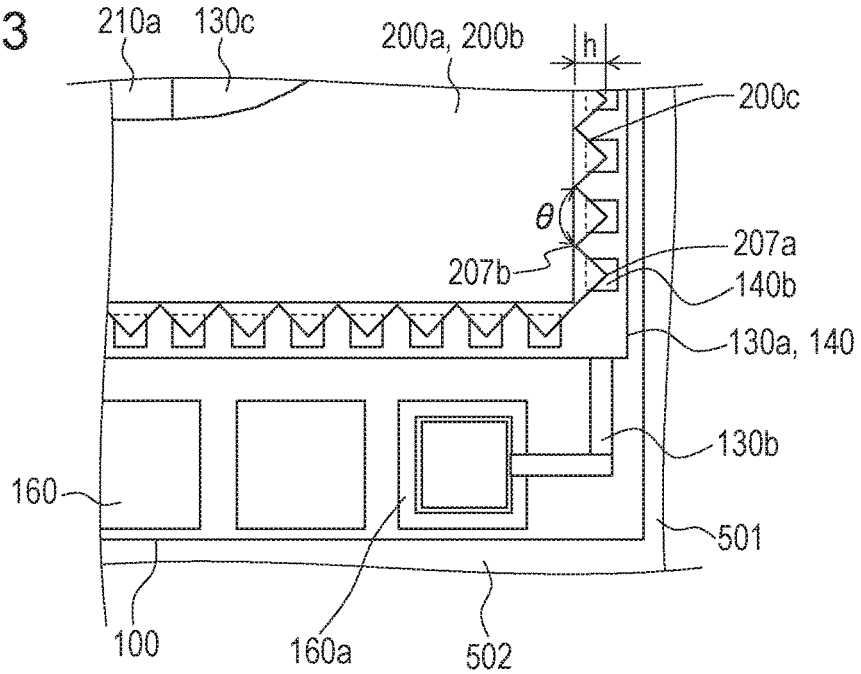
FIG. 13 is a magnified view of a portion XIII according to a third embodiment.

FIG. 13 is a magnified view of a portion XIII in FIG. 6 and illustrates a third embodiment of the aspects of the invention. In this embodiment, the exterior side surface 200*c* of the discharge port forming member 200 is serrated over the entire exterior side surface 200*c*. The exterior side surface 200*c* has peak portions 207*a* each extending from the second edge 200*e*, which is adjacent to the discharge port forming surface 206, to the first edge 200*d*. The edge of the peak portion 207*a* adjacent to the first edge 200*d* faces the conductive layer 130*a*. The peak portion 207*a* has a height h of 10 μm and an angle θ of 90°. As in the second embodiment, the third embodiment includes the adhesion improving layer 140 having the square openings 140*b* with four sides of 10 μm through which the conductive layer 130*a* is exposed. The openings 140*b* face the edges of the peak portions 207*a* adjacent to the first edge 200*d*. Although not illustrated, the openings 140*b* may face the edges of valleys 207*b* of the exterior side surface 200*c* adjacent to the first edge 200*d*.

The ESD damage to the wafer of the third embodiment after the cleaning step was checked, and it was found that the ESD damage occurred at fire places. This reduction may be achieved due to the fact that the ESD current flowing along the exterior side surface 200*c* of the discharge port forming member 200 by the surface discharge was concentrated on the peak portions 207*a*, which enables the ESD current to be more readily introduced to the conductive layer 130*a*. In the third embodiment, the adhesion between the element forming layer 110 and the discharge port forming member 200 is maintained, and the occurrence of the ESD damage is reduced.

Fourth Embodiment

Figure 14:
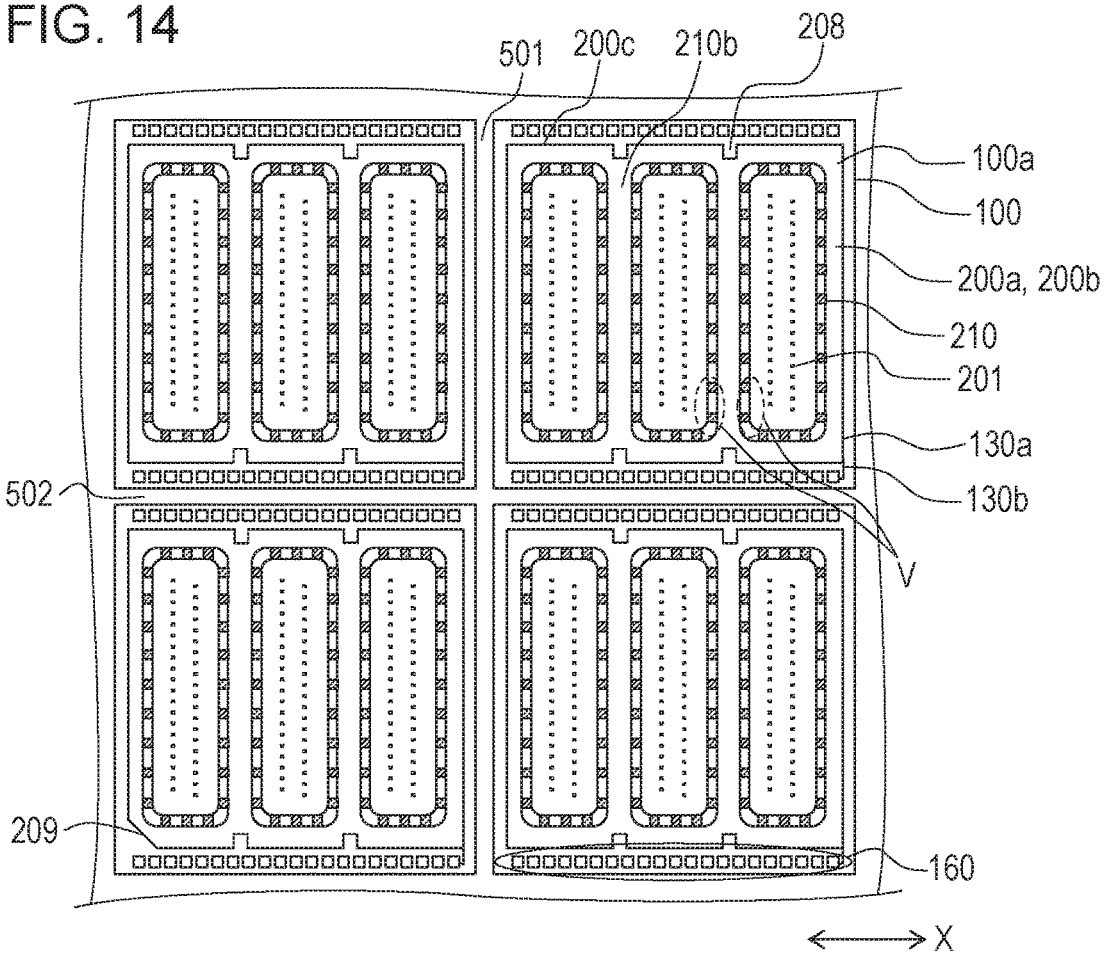
FIG. 14 is a plan view of a portion of a wafer according to a fourth embodiment.

FIG. 14 illustrates a fourth embodiment and corresponds to FIG. 6. In this embodiment, one element substrate region 100*a* includes three ink supply channels 101, and the heating resistors 111 are disposed on each side of the ink supply channels 101. Thus, the element substrate region 100*a* is about three times longer in the arrangement direction X in which the pads 160 are arranged than that in the first embodiment. Thus, three grooves 210 each surrounding a different set of the discharge ports 201 (the discharge to array 205) are provided. The wafer having a diameter of 200 mm includes 90 element substrates 1. The exterior side surface 200*c* of the discharge port forming member 200 has recesses (grooves) 208 each extending from the second edge 200*e*, which is adjacent to the discharge port forming surface 206, at a position adjacent to an inter-groove region 210*b* (region between adjacent two grooves 210) to the first edge 200*d*. In other words, the exterior side surface 200*c* of the discharge port forming member 200 is dented at the position adjacent to the inter-groove regions 210*b* toward the middle of the substrate 100. The recesses 208 each have a width of 100 μm and a depth of 100 μm.

Figure 15:
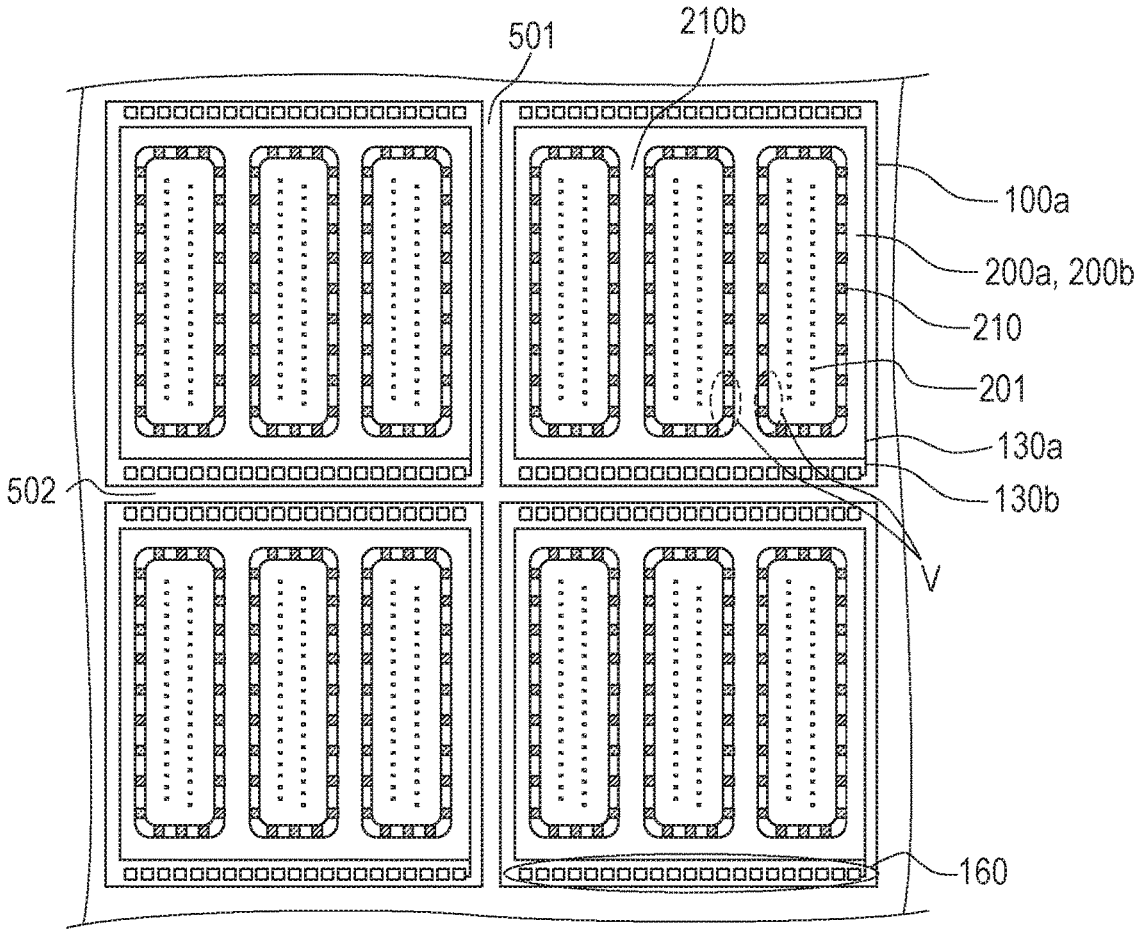
FIG. 15 is a plan view of a wafer according to a first modification.

A wafer (see FIG. 15) having the configuration identical to that of the fourth embodiment except that the recesses 208 are not included was formed as a first modification. The wafer of the first modification after the cleaning step had the ESD damage at 20 places in the entire wafer. In particular, the occurrence of the ESD damage increased at the ink supply channel 101 at the middle and portions V of the grooves 210, which are adjacent to the inter-groove region 210*b*.

In the fourth embodiment and the first modification, a distance between the middle of the discharge port forming member 200 and the edge of the discharge port forming member 200 on which the conductive layer 130*a* is disposed is large. Thus, the ESD current generated at the middle of the discharge port forming member 200 or the inter-groove regions 210*b* is readily introduced to the discharge ports 201 or the grooves 210.

Compared to the above, in the fourth embodiment, the number of occurrences of the ESD damage is reduced to 10. In particular, the occurrence of the ESD damage is reduced at the portions V, which are adjacent to the recess 208. This reduction may be achieved due to the fact that the recess 208 was provided such that the distance between the inter-groove region 210*b* and the conductive layer 130*a* becomes shorter as illustrated in FIG. 14, and thus the ESD current generated at the position around the recess 208, particularly at a position close to the conductive layer 130*a* was introduced to the recess 208.

In the first modification, which does not have the recess 208, the conductive layer 130*a*, which is disposed between the first edge 200*d* and the element forming layer 110, reduces the occurrence of the ESD damage. Thus, the recess 208 is an optional component.

As illustrated in FIG. 14, the discharge port forming member 200 may have a chamfered portion 209. The chamfered portion 209 is a border portion between adjacent two exterior side surfaces 200*c* and extends from the second edge 200*d* to the first edge 200*e*. If the corner of the discharge port forming member 200 is not chamfered, the distance between the groove 210 and the exterior side surface 200*c* of the discharge port forming member 200 is large. The chamfered portion 209 shortens the distance and enables the ESD current to be introduced to the exterior side surface 200*c* of the discharge port forming member 200.

In the above-described embodiments, the shape of the element substrate region 100*a* (or the element substrate 1) is not limited to oblong, and may be parallelogram, triangle, or any other polygon. The first and second heat storage layers 122 and 132 may be subjected to a planarization treatment. The liquid ejecting head having such a configuration obtains the same advantages.

The aspects of the present invention can be applied to a long liquid ejecting head. In the long liquid ejecting head, the resistance of the electrodes 150*a* and 150*b* for the heating resistor 111 tend to increase. The thickness of the electrodes 150*a* and 150*b* may be increased to reduce the resistance of the electrodes 150*a* and 150*b* without affecting the size of the substrate for the liquid ejecting head. In such a case, the covering properties of the protective film 131, which covers the electrodes 150*a* and 150*b*, are reduced, and thus the ESD damage readily occurs. In one aspect of the present invention, the ESD current caused in the discharge port forming member 200 is transferred to the conductive layer 130*a* along the exterior side surface 200*c* of the discharge port forming member 200 by the surface discharge. This reduces the occurrence of the ESD damage even in the liquid ejecting head including the electrodes 150*a* and 150*b* having a large thickness of 1000 nm or more.

While the aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-200916, filed Oct. 9, 2015, which is hereby incorporated by reference herein in its entirety.

What is claimed is:

1. An element substrate for a liquid ejecting head comprising:

a substrate;

an element forming layer on the substrate, the element forming layer including an energy generating element configured to provide energy to a liquid for ejection and an anticavitation layer covering the energy generating element;

a discharge port forming member formed of an insulating member on the element forming layer, the discharge port forming member including a discharge port forming surface having discharge ports through which the liquid is ejected and an exterior side surface positioned between the discharge port forming surface and the element forming layer, the exterior side surface having a first edge facing the element forming layer; and a conductive layer disposed between the first edge and the element forming layer and grounded;

wherein the conductive layer and the anticavitation layer are separated from each other.

2. The element substrate according to claim 1, wherein the conductive layer is electrically connected to the substrate.

3. The element substrate according to claim 1, wherein the element forming layer has a first surface on which the discharge port forming member is disposed, the first surface having an interior portion positioned under the discharge port forming member and an exterior portion located outwardly from the interior portion, and the element substrate further comprises:

a conductive pad disposed on the exterior portion of the element forming layer and connected to the substrate; and a connection layer disposed on the exterior portion of the element forming layer and connecting the conductive layer to the pad.

4. The element substrate according to claim 1, wherein the conductive layer extends along the first edge.

5. The element substrate according to claim 4, wherein the conductive layer extends continuously along the first edge over an entire circumference of the discharge port forming member.

6. The element substrate according to claim 1, wherein the discharge port forming member includes a groove surrounding the discharge ports and a bridge extending across the groove in a width direction.

7. The element substrate according to claim 1, wherein the element forming layer includes: an insulating protective film covering the energy generating element and extending to a position outside the discharge port forming member; and the anticavitation layer covering a portion of the insulating protective film, and the conductive layer is in contact with the insulating protective film at a position outside the discharge port forming member.

8. The element substrate according to claim 1, wherein the conductive layer and the anticavitation layer are formed of an identical material.

9. The element substrate according to claim 1, wherein the exterior side surface has a second edge forming a border between the exterior side surface and the discharge port forming surface and a peak portion extending from the second edge to the first edge, and an edge of the peak portion adjacent to the first edge faces the conductive layer.

10. The element substrate according to claim 1, wherein the exterior side surface includes a plurality of exterior side surfaces, each of the plurality of exterior side surfaces has a second edge forming a border between the exterior side surface and the discharge port forming surface, and adjacent two of the exterior side surfaces form a chamfered portion at a border between the exterior side surfaces, the chamfered portion extending from the second edge to the first edge.

11. An element substrate for a liquid ejecting head comprising:

a substrate;

an element forming layer on the substrate, the element forming layer including an energy generating element configured to provide energy to a liquid for ejection;

a discharge port forming member formed of an insulating member on the element forming layer, the discharge port forming member including a discharge port forming surface having discharge ports through which the liquid is ejected and an exterior side surface positioned between the discharge port forming surface and the element forming layer, the exterior side surface having a first edge facing the element forming layer; and a conductive layer disposed between the first edge and the element forming layer, wherein the discharge port forming member includes a groove surrounding the discharge ports and a bridge extending across the groove in a width direction, the groove includes a plurality of grooves each surrounding different discharge ports of the discharge ports, the discharge port forming surface has an inter-groove region between adjacent two of the grooves, and the exterior side surface has a second edge forming a border between the exterior side surface and the discharge port forming surface and has a recess extending from the second edge at a position adjacent to the inter-groove region to the first edge.

12. An element substrate for a liquid ejecting head comprising:

a substrate;

an element forming layer on the substrate, the element forming layer including an energy generating element configured to provide energy to a liquid for ejection;

a discharge port forming member formed of an insulating member on the element forming layer, the discharge port forming member including a discharge port forming surface having discharge ports through which the liquid is ejected and an exterior side surface positioned between the discharge port forming surface and the element forming layer, the exterior side surface having a first edge facing the element forming layer; and a conductive layer disposed between the first edge and the element forming layer, wherein the conductive layer extends over the first edge, and the element substrate further comprises an intermediate layer disposed on the conductive layer so as to extend over the first edge, the intermediate layer having higher adhesion to the discharge port forming member than the conductive layer and having an opening through which the first edge and the conductive layer are in contact with each other.

13. An element substrate for a liquid ejecting head comprising:

a substrate;

an element forming layer on the substrate, the element forming layer including an energy generating element configured to provide energy to a liquid for ejection;

a discharge port forming member formed of an insulating member on the element forming layer, the discharge port forming member including a discharge port forming surface having discharge ports through which the liquid is ejected and an exterior side surface positioned between the discharge port forming surface and the element forming layer, the exterior side surface having a first edge facing the element forming layer; and a conductive layer disposed between the first edge and the element forming layer, wherein the exterior side surface has a second edge forming a border between the exterior side surface and the discharge port forming surface and a peak portion extending from the second edge to the first edge, and the element substrate further comprises an intermediate layer disposed on the conductive layer so as to extend over the first edge, the intermediate layer having higher adhesion to the discharge port forming member than the conductive layer and having an opening through which the conductive layer is exposed, the opening facing an edge of the peak portion adjacent to the first edge.

14. A wafer comprising:

a plurality of element substrates each including:

a substrate;

an element forming layer on the substrate, the element forming layer including an energy generating element configured to provide energy to a liquid for ejection and an anticavitation layer covering the energy generating element;

a discharge port forming member formed of an insulating member on the element forming member, the discharge port forming member including a discharge port forming surface having discharge ports through which the liquid is ejected and an exterior side surface positioned between the discharge port forming surface and the element forming layer, the exterior side surface having a first edge facing the element forming layer; and a conductive layer positioned between the first edge and the element forming layer and connected to the substrate;

wherein the conductive layer and the anticavitation layer are separated from each other.

15. The wafer according to claim 14, wherein the conductive layer extends along the first edge.

16. The wafer according to claim 14, wherein the element forming layer includes: an insulating protective film covering the energy generating element and extending to a position outside the discharge port forming member; and the anticavitation layer covering a portion of the insulating protective film, and the conductive layer is in contact with the insulating protective film at a position outside the discharge port forming member.

17. A wafer comprising:

a plurality of element substrates each including:

a substrate;

an element forming layer on the substrate, the element forming layer including an energy generating element configured to provide energy to a liquid for ejection;

a discharge port forming member formed of an insulating member on the element forming member, the discharge port forming member including a discharge port forming surface having discharge ports through which the liquid is ejected and an exterior side surface positioned between the discharge port forming surface and the element forming layer, the exterior side surface having a first edge facing the element forming layer; and a conductive layer positioned between the first edge and the element forming layer, wherein the conductive layer extends over the first edge, and the element substrate further includes an intermediate layer on the conductive layer, the intermediate layer extending over the first edge and having higher adhesion to the discharge port forming member than the conductive layer, the intermediate layer having an opening through which the first edge and the conductive layer are in contact with each other.

* * * * *